US008650849B2

(12) United States Patent
Pede-Vogler

(10) Patent No.: US 8,650,849 B2
(45) Date of Patent: Feb. 18, 2014

(54) YARN FEED DEVICE

(75) Inventor: Walter Pede-Vogler, Durach (DE)

(73) Assignee: Oerlikon Textile GmbH & Co. KG., Remscheid (DE)

( * ) Notice: Subject to any disclaimer, the term of this patent is extended or adjusted under 35 U.S.C. 154(b) by 0 days.

(21) Appl. No.: 13/616,376

(22) Filed: Sep. 14, 2012

(65) Prior Publication Data

US 2013/0239540 A1 Sep. 19, 2013

(30) Foreign Application Priority Data

Sep. 16, 2011 (DE) ..... 10 2011 113 614

(51) Int. Cl.
*D01H 1/10* (2006.01)

(52) U.S. Cl.
USPC ..... 57/58.86

(58) Field of Classification Search
USPC ..... 57/58.86; 242/413, 413.9
See application file for complete search history.

(56) References Cited

U.S. PATENT DOCUMENTS

| | | | | | |
|---|---|---|---|---|---|
| 4,526,329 | A * | 7/1985 | Takeda | 242/155 M |
| 4,709,543 | A * | 12/1987 | Lorenz | 57/58.7 |
| 5,706,642 | A * | 1/1998 | Haselwander | 57/264 |
| 5,782,424 | A * | 7/1998 | Horvath et al. | 242/419.3 |
| 5,791,584 | A * | 8/1998 | Kuroiwa | 242/417.3 |
| 5,943,851 | A * | 8/1999 | Matas Gabalda et al. | 57/58.86 |
| 7,104,483 | B2 * | 9/2006 | D'Agnolo | 242/155 R |
| 8,256,199 | B2 * | 9/2012 | Schlagenhaft | 57/58.86 |
| 2011/0126506 | A1 | 6/2011 | Schlagenhaft | |

FOREIGN PATENT DOCUMENTS

| | | | |
|---|---|---|---|
| DE | 4121913 | A1 | 1/1992 |
| DE | 10030888 | B4 | 1/2002 |
| DE | 102008033849 | A1 | 1/2010 |
| EP | 1167597 | B1 | 1/2002 |
| WO | 2009052846 | A1 | 4/2009 |

* cited by examiner

*Primary Examiner* — Shaun R Hurley
(74) *Attorney, Agent, or Firm* — K&L Gates LLP

(57) ABSTRACT

A yarn feed device for the workstations of twisting or cabling machines wherein the yarn feed device (13) is a component of a retrofittable supplementary assembly set (12).

11 Claims, 4 Drawing Sheets

YARN FEED DEVICE

CROSS-REFERENCE TO RELATED APPLICATIONS

This application claims priority from German Patent Application No. DE 10 2011 113 614.6, filed Sep. 16, 2011, herein incorporated fully by reference in its entirety.

FIELD OF THE INVENTION

The present invention relates to a yarn feed device, in particular for the workstations of twisting or cabling machines.

BACKGROUND OF THE INVENTION

In conjunction with twisting or cabling machines, it is known to maintain the centrifugal forces in the yarn balloon owing to the revolving yarn in balance by means of corresponding counter-forces in the inflowing outer yarn in order to ensure stable running conditions during operation of a cabling spindle. These counter-forces are formed, for example, from the sum of the frictional forces in the cabling spindle, on the storage disc, on the yarn running path and by a yarn brake. The yarn brake can generally be set so that the different running and force conditions can be taken into account depending on the yarn count, type of yarn or yarn preparation. In conjunction with twisting or cabling machines, hysteresis brakes are often used as yarn brakes, which, equipped with specially formed friction wheels, allow a finely metered and careful use of the braking forces.

Twisting or cabling machines of this type with mechanisms for setting the yarn tension of the inner yarn and/or the outer yarn are described in numerous patent applications, for example in German Patent Publications DE 41 913 A1, or DE 100 30 888 B4, or in European Patent Publication EP 1 167 597 B1, sometimes in great detail.

In the cabling spindles known from German Patent Publication DE 100 30 888 B4 or European Patent Publication EP 1 167 597 B1, a storage disc is, for example, dispensed with and, instead, the yarn tension is controlled substantially by a pot rotating with the cabling spindle, which pot substantially prevents the formation of a free yarn balloon except for a residual balloon. The known cabling spindles are also, in each case, equipped with mechanisms particular to the workstation to set the yarn tension of the outer yarn, which mechanisms may be different in configuration.

It is, for example, described in German Patent Publication DE 100 30 888 B4 that this mechanism is either configured as a yarn brake or as a mechanism, with which the outer yarn can not only be braked, but also actively conveyed. The yarn influencing mechanism known from European Patent Publication EP 1 167 597 B1 is preferably also configured as an active feed device.

The use of a co-rotating pot has, however, proven to be disadvantageous in the cabling devices known from German Patent Publication DE 100 30 888 B4 or European Patent Publication EP 1 167 597 B1, as the pot, on the one hand, is subject to not insignificant wear owing to the rotating outer yarn and, on the other hand, also has to be moved as a rotating mass by the spindle drive. In addition, the air friction of the pot causes additional losses, which have to be compensated by the spindle drive.

A cabling spindle is known from German Patent Publication DE 41 21 913 A1, in which the yarn tension of an inner yarn and an outer yarn is influenced by means of adjusting mechanisms in such a way that the yarns at the cabling point have the same yarn tension and the same yarn speed. The inner yarn is acted upon here by an inner yarn brake, the braking effect of which is controlled depending on the outer yarn/balloon yarn tension.

The outer yarn is introduced centrally into the cabling spindle, proceeding from the outer yarn brake, and leaves radially at a rotating storage disc, which is fastened below the twist plate at the cabling spindle. The outer yarn loops the storage disc here, at least partially, before the yarn is transferred via the outer edge of the twist plate into a free yarn balloon.

As the shape and the diameter of a free yarn balloon decisively co-determine the energy consumption at each cabling spindle, it has furthermore already been proposed, for example by German Patent Publication DE 10 2008 033 849 A1, to set the feed speed of the outer yarn by means of an active yarn feed device in such a way that no yarn storage is adjusted, but the yarn tension adopts a value, which minimizes the diameter of the free yarn balloon circling around the spindle depending on the geometry of the spindle. It was possible to achieve considerable energy savings with the embodiment of a cabling spindle known from German Patent Publication DE 10 2008 033 849 A1 during operation compared to the cabling spindles known until then.

SUMMARY OF THE INVENTION

Proceeding from the aforementioned prior art, the invention is based on the object of developing a yarn feed device, which makes it possible, even in twisting or cabling machines already in use in practice, to significantly reduce the energy consumption.

This object is achieved according to the invention by a yarn feed device for the workstations of twisting or cabling machines, which have yarn brakes particular to the workstation to produce a yarn tension in the outer yarns, characterized in that the yarn feed device is a component of a retrofittable supplementary assembly set.

Advantageous embodiments of the invention are contemplated and are more fully described hereinafter.

The use according to the invention of a yarn feed device, which is a component of a retrofittable supplementary assembly set, has the advantage, in particular, that workstations of twisting or cabling machines that are already in use can still relatively easily and economically also be retrospectively modified in such a way that their energy consumption is significantly reduced. By using supplementary assembly sets of this type, it is possible, even with older twisting or cabling machines, to set the yarn tension of the outer yarn in such a way that the diameter of the yarn balloon circling around the cabling spindle is minimized, so a saving of the energy consumption at the cabling spindle of 20 to 30% becomes achievable. This means that many older twisting or cabling machines can relatively unproblematically be raised, with respect to energy consumption, to a standard, which virtually corresponds to the standard of twisting or cabling machines which are equipped as described in German Patent Publication DE 10 2008 033 849 A1.

The supplementary assembly set in a first embodiment has a drive that can be activated in a defined manner to rotate a yarn friction wheel. By means of the drive, the yarn speed and therefore the yarn tension of the outer yarn running over the friction wheel can be finely metered.

In other words, a gentle handling of the outer yarn is always ensured by the yarn feed device according to the invention. Owing to the continuous adaptation of the yarn speed, fluctuations in the feeding of the yarn, which can lead to a break of the yarn or to a collapse of the yarn balloon, are also reliably avoided. In this case, the yarn speed is used as a control variable for the yarn tension, the yarn tension being determined before or after the formation of the yarn balloon at the spindle. Alternatively, the power consumption of a drive being used to rotate the cabling spindle can, however, also be used as the control variable for the yarn tension. In other words, the yarn speed, by means of the yarn tension, as already stated, influences the diameter of the free yarn balloon, the dimension of which is decisive for the power consumption of the associated drive. A combination of said control variables is also conceivable to control the yarn tension as precisely as possible, the required monitoring of the yarn tension preferably being able to be carried out electronically and/or mechanically.

In an advantageous embodiment, the supplementary assembly set has two separately activatable drives, to which a yarn friction wheel is connected in each case to act on an outer yarn. A supplementary assembly set of this type is, in this case, fixed to walls of adjacent workstations. A configuration of this type has the great advantage that the outer yarns of two adjacent workstations can be conveyed simultaneously, a separate treatment of the outer yarns nevertheless being possible without problems because of a separate activation of the drives.

The supplementary assembly set, in an advantageous configuration, has a housing, with which it can be fixed to the walls of adjacent workstations.

The drives may be connected by control lines to controller boxes particular to the workstation, which are connected by means of a data bus to a centrally arranged control mechanism of the twisting or cabling machine. To set the aimed for yarn tension of the outer yarns, the drives can be activated in such a way that the yarn speed of the outer yarns required for this is always ensured. In other words, the yarn tension of the outer yarns is set by the drives by means of the yarn speed in such a way that the associated yarn balloons always have their minimum diameter, predetermined in each case by the diameter of the bobbin receiving pot of the associated cabling spindle.

It may be provided that the drives of the yarn feed device can influence the yarn speed of the outer yarns both in the direction of "accelerate" and in the direction of "brake". A reliable and simple setting of the respectively required yarn tension of the outer yarns is thus possible.

The drives are preferably configured as stepping motors. Stepping motors of this type are mass produced parts that are economically available commercially and have proven successful in drive technology.

It is provided in an advantageous embodiment that the yarn friction wheels of the supplementary assembly set are arranged in the yarn running path of two outer yarns in such a way that they are positioned in each case in the yarn running direction behind the yarn friction wheels of the existing yarn brakes particular to the workstation. An arrangement of this type ensures that in every operating state, in other words both when starting up a workstation and during the regular cabling operation, an outer yarn loaded with tensile stress is present at the yarn brakes.

The yarn brakes particular to the workstation are preferably configured as hysteresis brakes which are activatable in a defined manner. Hysteresis brakes of this type have the advantage, in particular, that the force produced/the moment produced, are not speed-dependent or rotational speed-dependent, in other words, a hysteresis brake, from standstill to a structurally predetermined maximum rotational speed, always has a uniform braking torque, which can obviously be set precisely when necessary The control mechanism for the drives and/or the controller boxes particular to the workstation may be configured in such a way that they only set the respective yarn tension of the outer yarn after a workstation has been run up to speed and during the subsequent twisting or cabling operation by means of the yarn feed device of the supplementary assembly set. The means that the control mechanism for the drives and/or the controller boxes set the yarn tension of the outer yarns by means of the yarn feed device according to the invention during most of the time of the cabling operation, but not during the starting up of the workstations.

The workstations are run up to operating speed in a proven manner using the yarn brakes particular to the workstation already present beforehand. The control mechanism for the drives of the yarn feed devices can be integrated into the existing central control mechanism of the machine (claim 11).

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
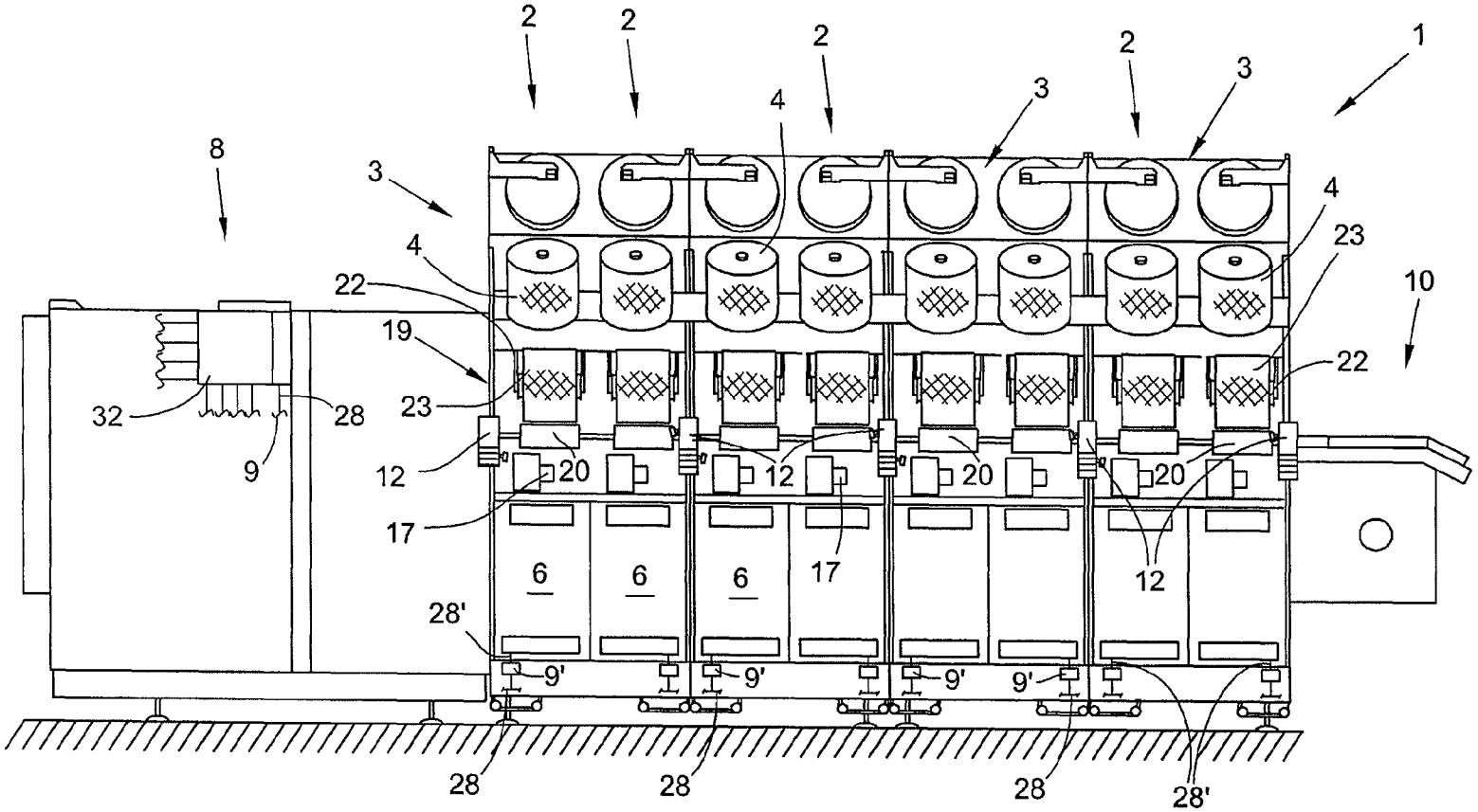
FIG. 1 shows a schematic front view of a twisting or cabling machine, the workstations of which are equipped with the supplementary assembly sets according to the invention.

FIG. 1 shows a schematic front view of a twisting or cabling machine 1. Textile machines of this type, in the region of their machine longitudinal sides, in each case have a large number of identical workstations 2. Moreover, textile machines of this type generally have a drive and operating unit 8, which is arranged at the end of the machine and in which, for example, the required energy mechanisms, various drives and a central control mechanism 32 are installed. In the embodiment, the twisting or cabling machine 1 furthermore has a bobbin transporting system, the schematically shown delivery point of which is designated by the reference numeral 10.

As known, workstations 2 of twisting or cabling machines 1 with an outer yarn feed in each case have a creel 3, which is used to receive at least a first supply bobbin 4, from which a so-called outer yarn 5 is drawn off. Workstations 2 of this type furthermore have, which is not shown in more detail in the figures of the present application for reasons of better clarity, a respective cabling spindle, which is driven by a spindle drive. A spindle drive of this type may be a motor, which directly drives the cabling spindle, or an indirect drive, for example a belt drive. The cabling spindle arranged in the embodiment of FIG. 1, in each case, behind a displaceably mounted protection wall 6, also carries, on a stationary bobbin pot base arranged on the cabling spindle, as usual, a second supply bobbin, from which a so-called inner yarn is drawn off overhead, which, above the cabling spindle, is fed to a balloon eyelet or a compensation system 7.

Figure 2:
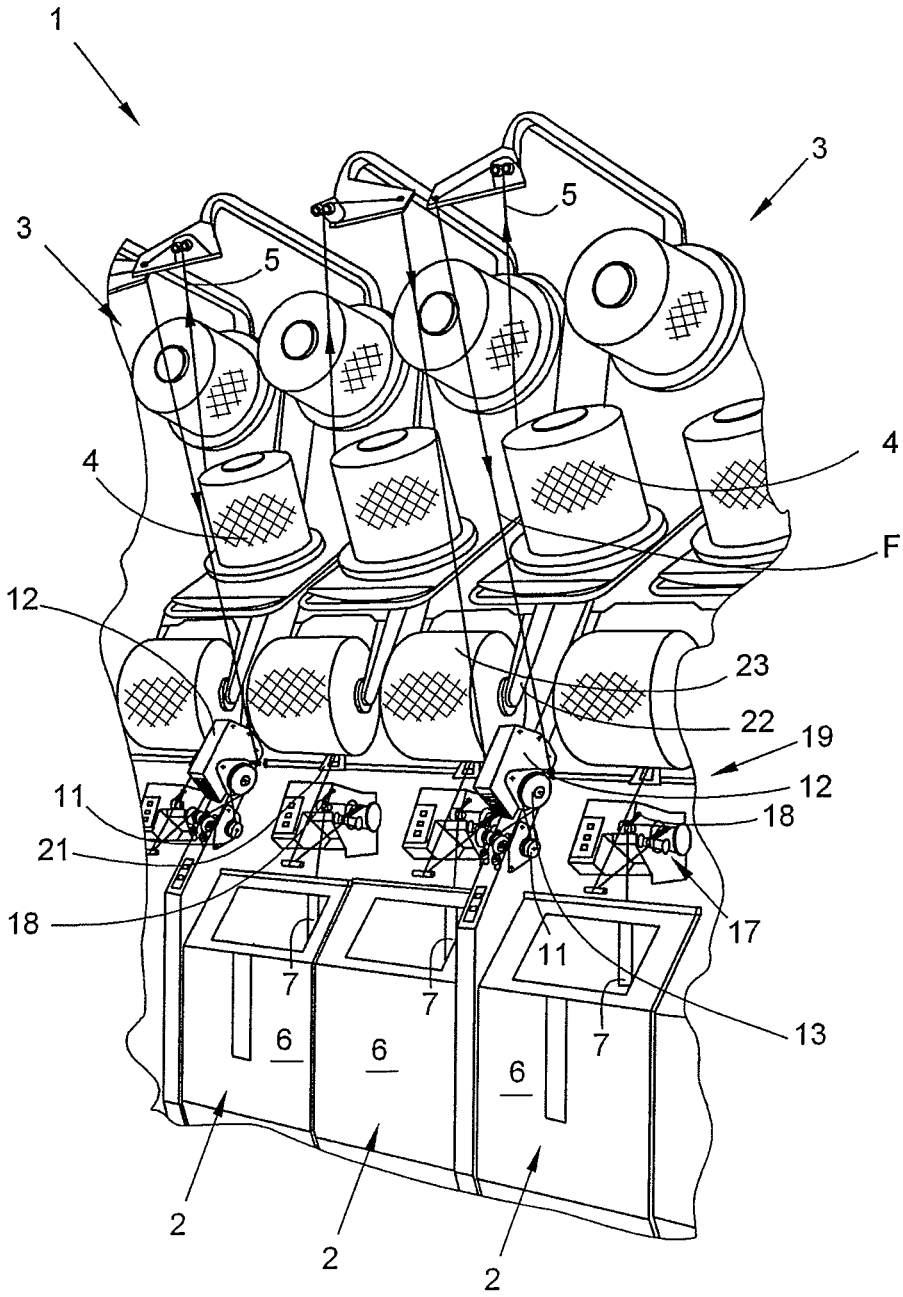
FIG. 2 shows a schematic view of some of the workstations of the twisting or cabling machine shown in FIG. 1.
Figure 3:
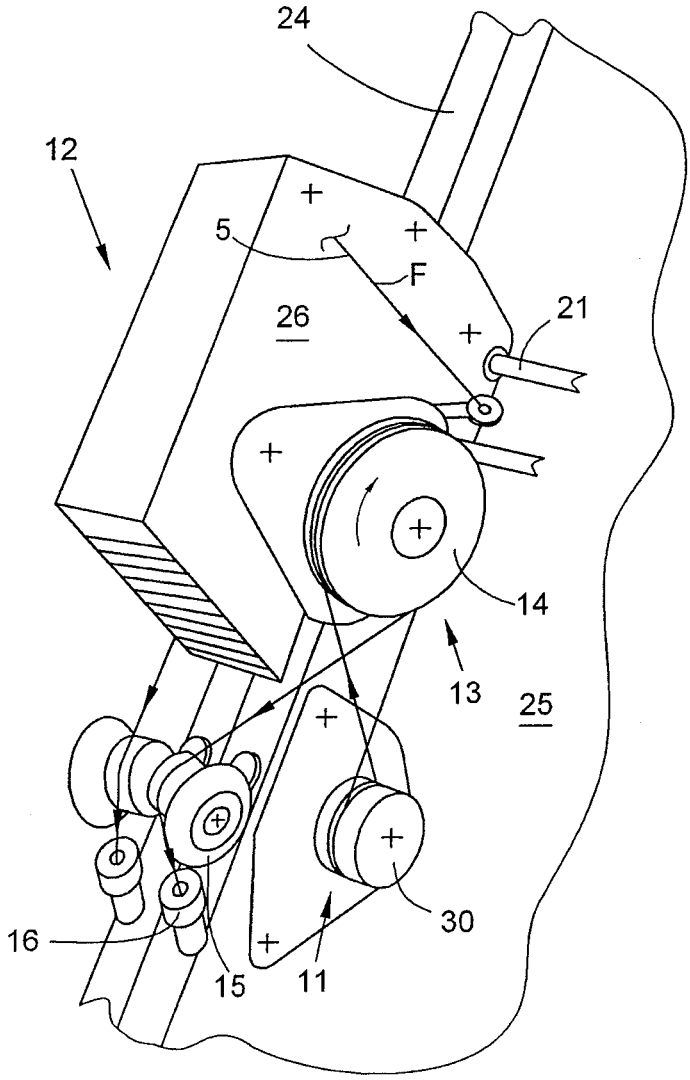
FIG. 3 shows a detailed view of a yarn feed device present in the form of a supplementary assembly set and the yarn running path of the outer yarn in this region.

As shown in FIG. 2, the outer yarn 5 drawn off from the first supply bobbin 4, which is stored in the creel 3, is firstly fed to a yarn tension influencing device, by means of which the yarn tension of the outer yarn 5 can be varied or set. As can be seen, in particular from FIGS. 2 and 3, this yarn tension influencing device substantially consists of a yarn brake 11 particular to the workstation and preferably configured as a hysteresis brake, and an active yarn feed device 13, comprised of a pair of individual feed devices 13A and 13B, arranged in a retrofittable supplementary assembly set 12. The hysteresis brake 11 is connected to a control mechanism 32 present. For the control of the drives 27A, 27B of yarn friction wheels 14 of the feed devices 13A, 13B, a further control mechanism 9 is present, which can be integrated in the control mechanism present or can be configured separately. Alternatively, a plurality of control mechanisms may be provided, which are arranged, for example, section wise. The control mechanism 9 is coupled by a means of a data bus 28 to controller boxes 9' at the workstations 2, which are in turn equipped with measuring and control mechanisms in order to be able to control, in a workstation-specific manner, the control of the yarn speed and therefore the yarn tension.

The respective hysteresis brake 11 and the associated yarn feed device 13 of the supplementary assembly set 12 are, as usual, installed in front of the cabling spindle, viewed in the yarn running direction F.

In other words, the outer yarn 5 coming from the first supply bobbin 4 firstly circles around the yarn friction wheel 30 of the hysteresis brake 11, is then acted on by the yarn friction wheel 14 of the yarn feed device 13 and deflected by means of a deflection roller 15 into a yarn guide channel 16. Via the yarn guide channel 16, the outer yarn 5 then arrives at the cabling spindle, where it enters through the rotational axis into the spindle drive and leaves the spindle drive again below the twist plate. The outer yarn 5 then circles around the cabling spindle with the formation of a free yarn balloon. A balloon eyelet or the compensation system 7, in which the outer yarn 5 drawn off from the first supply bobbin 4 and the inner yarn (not shown) drawn off from the second supply bobbin are brought together, in this case determines the height of the free yarn balloon being formed. The cabling point, at which the outer yarn 5 and the inner yarn run together, is located in the compensation system 7.

As can be seen from FIG. 2, arranged above the cabling point is a draw-off device 17, by means of which the cabled yarn is drawn off and fed via a compensation element, for example a dancer arm 18, to a winding device 19. The winding device 19, as usual, has a drive roller 20 and a yarn traversing mechanism 21. By means of the yarn traversing mechanism 21, the cabled yarn is wound onto a cross-wound bobbin 23 driven with frictional engagement by the drive roller 20 and held in a creel 22.

Figure 4:
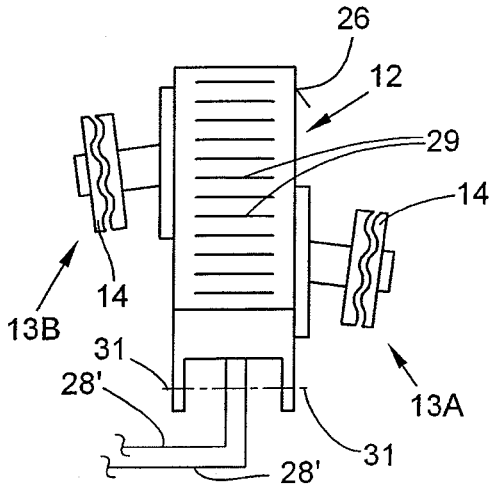
FIG. 4 shows the supplementary assembly set according to the invention in a front view.
Figure 5:
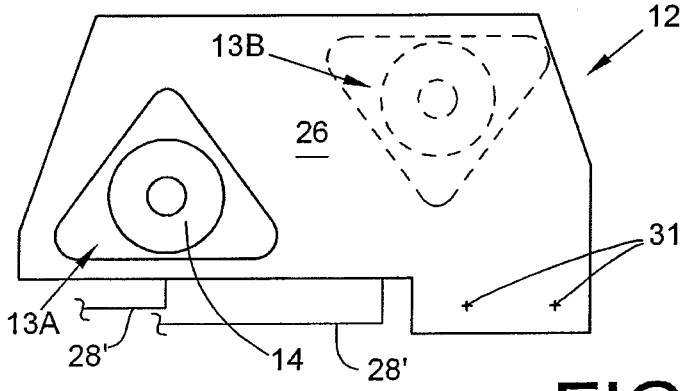
FIG. 5 shows the supplementary assembly set according to FIG. 4 in a side view.
Figure 6:
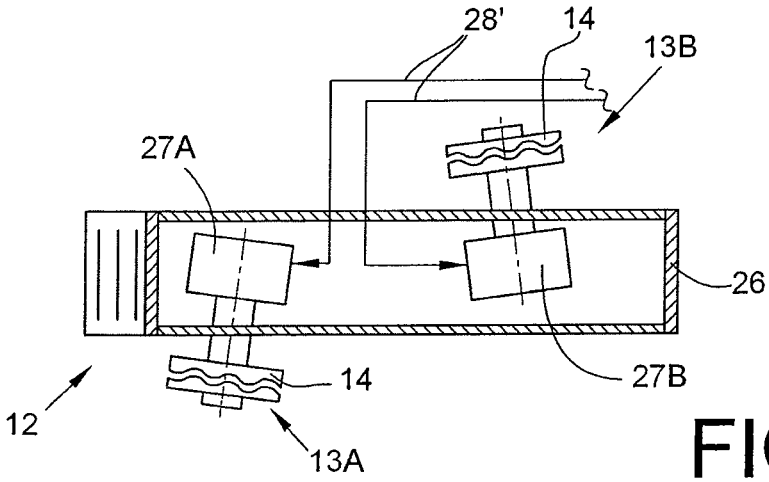
FIG. 6 shows the supplementary assembly set according to FIG. 4 in a plan view and in section.

The retrofittable supplementary assembly set 12 according to the invention has, as can be seen, in particular from FIGS. 4 to 6, a housing 26, which can be fixed, for example detachably, for example by means of screw bolts 31 or the like, to the walls 24, 25 of workstations 2 of a twisting or cabling machine 1. Drives 27A and 27B, which are supported in corresponding bearing mechanisms and on the motor shaft of which a yarn friction wheel 14 is arranged in each case, are mounted in the housing 26. The motor shafts of the drives 27A, 27B are preferably arranged inclined in such a way that an unproblematical transfer of the outer yarns 5 from the yarn friction wheels 14 of the yarn feed devices 13 to the deflection rollers 15 is ensured.

In order to prevent overheating of the drives 27A, 27B, the housing 26 also has ventilating slots 29.

The drives 27A, 27B, which, by means of the yarn friction wheels 14, predetermine the yarn speed and therefore also the yarn tension of the outer yarns 5, are furthermore connected by control lines 28' to respective controller boxes and these are in turn connected by a data bus 28 to a control mechanism 9 and by supply lines (not shown) to the energy supply mechanism of the twisting or cabling machine.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Yarn feed device for the workstations of twisting or cabling machines, which have yarn brakes particular to the workstation to produce a yarn tension in the outer yarns, characterized in that the yarn feed device (13) is a component of a retrofittable supplementary assembly set (12) which can be fixed to walls (24, 25) of adjacent workstations (2) and has two separately activatable drives (27A, 27B), to which a yarn friction wheel (14) is connected, in each case, to act on an outer yarn (5).

2. Yarn feed device according to claim 1, characterized in that the supplementary assembly set (12) has at least one drive (27A, 27B), which can be activated in a defined manner, to rotate a yarn friction wheel (14) of the yarn feed device (13).

3. Yarn feed device according to claim 1, characterized in that the supplementary assembly set has a housing (26), with which it can be fixed to the walls of adjacent workstations (2).

4. Yarn feed device according to claim 2, characterized in that the drives (27A, 27B) are connected by control lines (28) to controller boxes (9') particular to the workstation, which are connected by a data bus to a central control mechanism (9) at the twisting or cabling machine (1).

5. Yarn feed device according to claim 2, characterized in that the drives (27A, 27B) can be activated to rotate the friction wheel (14) in such a way that the yarn speed is set to achieve the aimed for yarn tension of the outer yarns (5).

6. Yarn feed device according to claim 4, characterized in that the yarn speed of the outer yarns (5) can be changed by means of the drives (27A, 27B) both in the direction of "accelerate" and in the direction of "brake".

7. Yarn feed device according to claim 2, characterized in that the drives (27A, 27B) are configured as stepping motors.

8. Yarn feed device according to claim 1, characterized in that the supplementary assembly set (12) is arranged in the yarn running path of two outer yarns (5) in such a way that the yarn friction wheels (14) of the supplementary assembly set (12) are in each case arranged in the yarn running direction (F) behind the yarn friction wheels (30) of the existing yarn brakes (11) particular to the workstation.

9. Yarn feed device according to claim 8, characterized in that the control mechanism (9) for the drives (27A, 27B) and/or controller boxes (9') are configured in such a way that they only set the respective yarn tension after a workstation (2) has been run up to speed and during the subsequent twisting or cabling operation by means of the yarn feed device (13) of the supplementary assembly set (12).

10. Yarn feed device according to claim 9, characterized in that the control mechanism (9) is integrated in the existing central control mechanism (32).

11. Yarn feed device according to claim 1, characterized in that the drives 27A, 27B have motor shafts inclined to promote transfer of the outer yarns 5 from the yarn friction wheels 14.

* * * * *